US005843630A

United States Patent [19]

Masson

[11] Patent Number: 5,843,630

[45] Date of Patent: Dec. 1, 1998

[54] CONCENTRATED SOLUTION AND KIT FOR MAKING A PHOTOGRAPHIC COLOR DEVELOPER

[75] Inventor: Jean Pierre Masson, Farges les Chalon, France

[73] Assignee: Eastman Kodak Company, Rochester, N.Y.

[21] Appl. No.: 695,500

[22] Filed: Aug. 9, 1996

[30] Foreign Application Priority Data

Aug. 11, 1995 [FR] France ..... 95 09896

[51] Int. Cl.[6] ..... G03C 7/413

[52] U.S. Cl. ..... 430/466; 430/467; 430/469

[58] Field of Search ..... 430/466, 467, 430/469

[56] References Cited

U.S. PATENT DOCUMENTS

| | | | |
|---|---|---|---|
| 3,574,619 | 4/1971 | Surash | 430/466 |
| 3,814,606 | 6/1974 | Ozawa et al. | 430/466 |
| 4,232,113 | 11/1980 | Marchesano | 430/450 |
| 4,814,260 | 3/1989 | Koboshi et al. | 430/468 |
| 4,873,180 | 10/1989 | Marchesano et al. | 430/468 |
| 4,897,339 | 1/1990 | Andoh et al. | 430/489 |
| 4,933,265 | 6/1990 | Inoue et al. | 430/489 |
| 5,079,133 | 1/1992 | Mitsui et al. | 430/469 |
| 5,354,646 | 10/1994 | Kobayashi et al. | 430/487 |

*Primary Examiner*—Hoa Van Le
*Attorney, Agent, or Firm*—J. Lanny Tucker

[57] ABSTRACT

A photographic concentrate for preparing a color developer comprises benzyl alcohol, water and organic solvents. This concentrate can be part of a kit for preparing a color developer along with 2 other concentrated solutions.

The noted concentrated solution comprises benzyl alcohol at between 25 and 35%, water at between 3 and 8%, ethylene glycol at between 10 and 20% and diethylene glycol at between 35 and 60%.

10 Claims, No Drawings

CONCENTRATED SOLUTION AND KIT FOR MAKING A PHOTOGRAPHIC COLOR DEVELOPER

FIELD OF THE INVENTION

The present invention relates to a concentrated benzyl alcohol solution useful for preparing a color developer. The invention also relates to a kit of components for preparing the color developer, and to a photographic processing method using this concentrated solution.

BACKGROUND OF THE INVENTION

In the field of photographic paper and film processing, color developing solutions are used comprising, as the main constituents, a developing agent, benzyl alcohol as a permeability agent and alkaline bases. It is known that photographic processing solutions are packaged in the form of concentrated liquid solutions (hereinafter referred to as "concentrates"). For example, color developers are often packaged in the form of several concentrates which are mixed at the time of preparation of the developer. These concentrates are particularly useful when there are stability problems with the various compounds constituting the ready-to-use processing solution. They also make it possible to solubilize each compound in the appropriate solvent. A clear homogenous ready-to-use developing solution must be obtained from these concentrates in a very short time without using complex handling.

For example, U.S. Pat. No. 3,574,619 describes a concentrated acidic solution comprising water, benzyl alcohol, a p-phenylenediamine, a sulfite and a liquid glycol present in the quantity necessary to obtain a uniform dispersion. According to this reference, a single glycol compound is used, chosen from ethylene glycol, propylene glycol, diethylene glycol and triethylene glycol. Example 1 of the patent shows that it is possible to obtain a clear solution containing 67% benzyl alcohol, 10% water and 20% ethylene glycol. In all the other examples in the reference, the concentrate based on benzyl alcohol and glycol also contains p-phenylenediamine color developing agent.

U.S. Pat. No. 4,232,113 describes a concentrate in which a solution of 5 to 50 g of p-phenylenediamine color developing agent in 100 ml of organic solvent is used to obtain a solution containing a quantity of water less than or equal to 5% of the total volume of the solution. The organic solvent is neutral and miscible in water in any proportion and can be chosen from amongst polyalcohols, polyoxyethylene glycols, or a mixture of these compounds. This concentrate can also contain benzyl alcohol. According to this reference, the developing composition is prepared by mixing this concentrate with at least a second concentrate consisting of an alkaline aqueous solution, and optionally with a third concentrate consisting of hydroxylamine, either in aqueous solution or in solution in an organic solvent.

The known concentrated color developing solutions do not give complete satisfaction because of (1) the difficulty of dissolving the concentrates in water, in particular concentrates comprising benzyl alcohol, and (2) the instability of these concentrates, in particular concentrates containing the developer, for example p-phenylenediamine. These problems of solubilization and stability give rise to a waste of time and the formation of tars in the developer.

In order to remedy the problems of solubilization and stability mentioned above, commercially available color developers are packaged in the form of three concentrates, such as for example the developer for EKTACHROME-R3® photographic processing: a first concentrate which contains benzyl alcohol in aqueous solution, a second concentrate which contains the color developer, and a third concentrate which contains one or more alkaline compounds in aqueous solution.

Benzyl alcohol has a high chemical oxygen demand (COD), and this is why it is desirable to use it in as low quantity as possible. This reduction in the quantity of benzyl alcohol is all the more necessary as legislation is increasingly severe with regard to COD. When, in the benzyl alcohol-containing concentrate, attempts are made to reduce the quantity of this alcohol, it is also necessary to reduce the quantity of water in order to keep a concentrate which is stable and homogeneous and which is rapidly solubilizable in water. However, the reduction in the quantity of water contained in this concentrate gives rise to problems of solubilization of the other photographically useful compounds present in the concentrate.

It would therefore be particularly desirable to obtain a concentrate with a reduced benzyl alcohol content having improved stability and being rapidly solubilizable in water in order to provide rapid preparation of a ready-to-use developer.

SUMMARY OF THE INVENTION

The problem is resolved by the present invention, which is a concentrated solution comprising: 25–35% benzyl alcohol, 3–8% water, 10–20% ethylene glycol, and 35–60% diethylene glycol, the percentages being based on total solution weight, and the sum of the percentages not exceeding 100%.

This invention also provides a kit for providing a photographic color developer, the kit comprising a first concentrated solution comprising:

25–35% benzyl alcohol,

3–8% water,

10–20% ethylene glycol, and

35–60% diethylene glycol, the percentages being based on total solution weight, and the sum of the percentages not exceeding 100%, a second concentrated solution comprising a color developing agent in aqueous phase, and a third concentrated alkaline solution different from the first and second concentrated solutions.

This invention also provides a photographic color developer prepared by mixing a first concentrated solution comprising:

25–35% benzyl alcohol,

3–8% water,

10–20% ethylene glycol, and

35–60% diethylene glycol, the percentages being based on total solution weight, and the sum of the percentages not exceeding 100%, a second concentrated solution comprising a color developing agent, and a third concentrated alkaline solution different from the first and second concentrated solutions.

This invention further provides a color reversal processing method comprising:

A) developing only the silver in an imagewise exposed color reversal photographic material, B) light exposing or chemically fogging residual silver halide grains in the material, C) color developing the material with the color developer prepared by mixing a first concentrated solution comprising:

25–35% benzyl alcohol,

3–8% water,

10–20% ethylene glycol, and

35–60% diethylene glycol, the percentages being based on total solution weight, and the sum of the percentages not exceeding 100%, a second concentrated solution comprising a color developing agent, and a third concentrated alkaline solution different from the first and second concentrated solutions, D) bleaching said color developed material, and E) fixing said bleached material.

DETAILED DESCRIPTION OF THE INVENTION

According to the present invention, it is now possible to obtain a concentrated solution for color photographic development having reduced water and benzyl alcohol contents and a particular mixture of solvents while maintaining the photographic activity of the developer. This concentrate has a reduced COD and a reduced solubilizing time in water. The time required for solubilizing in water this concentrate is also referred to in the art as the "miscibility time".

The first concentrated benzyl alcohol solution of this invention comprises benzyl alcohol at from 25 to 35%, water at from 3 to 8%, ethylene glycol at from 10 to 20% and diethylene glycol at from 35 and 60%.

This concentrated solution containing benzyl alcohol, water and the co-solvents ethylene glycol and/or diethylene glycol is referred to in the remainder of the description as "concentrate (A)". The percentages are, unless otherwise indicated, based on the total weight of the concentrate and the sum of the percentages does not exceed 100%.

According to a preferred embodiment, in the concentrate (A) according to the invention, the quantity of benzyl alcohol is between 25 and 35%, the quantity of water is approximately 5±1% (or between 4 and 6), the quantity of ethylene glycol is between 13 and 17% and the quantity of diethylene glycol is between 43 and 55%.

Benzyl alcohol is commonly used in photographic solutions as a permeability agent, that is to say it assists in particular the reaction between the oxidation product of the developer in aqueous phase and the coupler in non-aqueous phase.

Ethylene glycol and diethylene glycol form part of many organic co-solvents known to aid solubilization of organic compounds in water. According to the present invention, the choice of the particular organic cosolvents in specific proportions and the reduction in the quantity of water in concentrate (A) make it possible to reduce substantially the miscibility time of concentrate (A) in the quantity of water required to obtain the ready-to-use developer.

Concentrate (A) of the invention may contain other compounds commonly used in photographic processing baths. For example, this concentrate may contain organic antioxidants such as amines (propylamine, propylenediamine, hydroxylamine and their derivatives, etc.). It may also contain a solvent for silver halides such as DTOD (2,2-ethylene dithioethanol).

A preferred concentrate (A) contains benzyl alcohol, ethylene glycol, diethylene glycol, at least one antioxidant, preferably hydroxylamine chlorhydrate, and at least one solvent for silver halides, preferable DTOD.

The color developer of this invention is provided in and prepared from a kit consisting of three concentrated solutions in three separate containers: concentrate (A) as described above, which contains benzyl alcohol; a second concentrated solution (B) which contains a color developing agent in aqueous solution, and a third concentrated solution (C) which contains an alkaline compound or compounds in aqueous solution. These concentrates are mixed at the time of use either to prepare the color developer or to prepare a replenisher solution designed to maintain the efficacy of the color developer during use. In the following description and the claims accompanying it, the term "color developer" designates either the original color developer solution or the color developer replenisher.

The color developing agents used in concentrated solution (B) are in general p-phenylenediamines, for example 2-amino-5-diethylaminotoluene (known as CD2), 4-amino-N-ethyl-N-(β-methanesulfoamidoethyl)-m-toluidine (CD3), 4-amino-3-methyl-N-ethyl-N-(β-hydroxyethyl)-aniline (CD4). CD2 is generally used in color developers for color positive films, CD3 is generally used in color developers for color reversal films and papers, and CD4 is generally used in developers for color negative films.

Concentrated solution (B) containing the p-phenylene diamine developing agent may contain other compounds such as, for example, antioxidants or surfactants. Within the framework of the invention, concentrated solution (B) is in the form of an aqueous solution. The antioxidants which may be used in concentrated solution (B) are for example sulfites, metabisulfites and bisulfites of alkali metals, sulfurated compounds capable of generating sulfite ions in aqueous solutions, ascorbic acid and its derivatives, etc.

Concentrated solution (C) containing the alkaline compound or compounds is obtained from alkaline compounds such as sodium or potassium carbonate, borax, sodium or potassium hydroxide, or sodium metaborate in aqueous solution. This concentrated solution (C) generally contains sequestering agents and anti-liming agents such as aminopolycarboxylic acids, for example ethylenediaminetetracetic acid (EDTA), diethylenetriaminepentacetic acid (DTPA), isopropanoldiaminetetracetic acid (DPTA), aminopolyphosphonic acids, for example amino-N,N, dimethylenephosphonic acids, hexametaphosphate, DEQUEST® (2000, 2006, 2010, etc.,) or VERSENEX 80®.

Antiseptic compounds, anti-fogging agents, heat stabilizers, development activators such as thioether or oxothioether compounds and benzylamine may be added to these three concentrate solutions.

The color developer of the present invention is obtained by mixing first of all concentrated solution (A) in water. When this mixture is homogeneous, concentrated solution (B) is introduced, and then concentrated solution (C), stirring after the introduction of each concentrate in order to obtain a homogeneous clear liquid. The pH of the resulting color developer is advantageously between 10.5 and 11.5.

According to one embodiment, the color developer is intended for the processing of reversal photographic products. This processing comprises a latent image silver development step (black and white development), a reversal step which consists of making the non-exposed residual silver halide grains developable by means of a fogging light exposure or a chemical fogging, a fogged grain color development step, a washing step, and a bleaching step followed by a fixing step.

The silver development is effected in the presence of a reducing compound which enables the exposed silver halide grains to be transformed into metal silver. These compounds are described in paragraph XIX A of *Research Disclosure* of September 1994, Article 36544, hereinafter referred to as "*Research Disclosure*", and may be chosen from amongst dihydroxybenzenes such as hydroquinone, 3-pyrazolidones, aminophenols, ascorbic acid, etc. and mixtures of these.

The reversal step may be effected by exposure to light, chemical step, for example by passing through a fogging bath containing a reducer, or by the introduction of the fogging agent into the color developer. Fogging substances are for example stannous chloride, hydrazine and semicarbazide salts, ethylenediamine, sodium borohydride, dimethylborane or thiourea dioxide.

The color development step makes it possible to obtain a color image using a color developer, such as the ones described in paragraph XIX A of *Research Disclosure*. During this step, reduction of the silver halide grains fogged during the reversal step is effected for example by means of p-phenylenediamine. The oxidized p-phenylenediamine then reacts with a dyeforming coupler present in the photographic emulsion layer in order to form a color image.

Bleaching of the photographic product is obtained by means of an oxidizing compound which transforms the metallic silver into silver ions, such as the ones described in paragraph XX A of *Research Disclosure*. The oxidizing compound can be chosen from amongst the alkali metal salts of a ferric complex of an aminocarboxylic acid, or persulfate compounds. The bleaching compounds habitually used are ferric complexes of nitrolotriacetic acid, ethylene diamine tetraacetic acid, 1,3-propylenediamine tetraacetic acid, triethylenetriamine pentaacetic acid, orthodiaminocyclohexane tetraacetic acid and ethyliminodiacetic acid.

The fixing bath enables the silver halides to be totally transformed into water-soluble silver complexes, which are then eliminated from the layers of the photographic product by washing. The compounds used for fixing are described in paragraph XX B of *Research Disclosure*, for example thiosulfates such as ammonium thiosulfate or thiosulfates of alkali metals.

The bleaching step and the fixing step may be replaced by a single bleaching/fixing step as described in paragraph XX C of *Research Disclosure*.

The present invention is illustrated by the following examples.

EXAMPLE 1 (Reference)

EKTACHROME R-3® Color Developer 50 ml of a concentrated solution (A) was prepared, containing the benzyl alcohol required for the preparation of a liter of a replenisher for a ready-to-use color developer, by mixing the following compounds:

| CONCENTRATE A | | |
|---|---|---|
| Benzyl alcohol | 19.25 g | 35% |
| Diethylene glycol | 15.0 g | 27.3% |
| Ethylene glycol | — | |
| AgX solvent DTOD[1] | 0.3 g | 0.54% |
| HACl[2] | 5.6 g | 10.2% |
| Water | 14.8 g | 26.9% |

[1]HO—$CH_2CH_2$—S—$CH_2CH_2$—S—$CH_2CH_2$—OH
[2]Hydroxylamine chlorhydrate

This concentrated solution (A) does not contain any ethylene glycol.

To prepare a liter of replenisher for a ready-to-use color developer, concentrated solution (A) is mixed with ¾ of the quantity of water required to obtain 1 liter of the replenisher for a developer. The temperature of the water is between 30° and 35°C. This mixture is stirred until a clear solution is obtained (which determines the miscibility time). Concentrated solution (B) is then added, and then concentrated solution (C) of the EKTACHROME-R3® photographic process sold by KODAK. The mixture is stirred after adding concentrated solution (B) and after adding concentrated solution (C).

The quantity of water required to obtain 1 liter of replenisher for a developer is then added to this mixture.

Concentrated solution (B) is an aqueous concentrate which contains the developer CD3, sodium metabisulfite as an antioxidant and a non-ionic surfactant.

Concentrated solution (C) is an aqueous concentrate which contains potassium carbonate, potassium hydroxide, sodium sulfite, an anti-liming agent and a sequestering agent.

The pH of the ready-to-use replenisher is adjusted to 10.45 by adding NaOH/KOH.

For one liter of the replenisher the contribution of concentrated solution (A) to the COD is equal to 65 g for a total COD of approximately 75 g and the miscibility time of concentrated solution (A) in water is 110 seconds.

In all the examples the times indicated are those measured for a volume of 2 liters under stirring obtained with a magnetic bar.

EXAMPLE 2 (comparative)

35 ml of a concentrated solution (A) was prepared, containing the benzyl alcohol required for the preparation of a liter of replenisher for a ready-to-use color developer, by mixing the following compounds:

| CONCENTRATE A | | |
|---|---|---|
| Benzyl alcohol | 13.5 g | 34.8% |
| Diethylene glycol | 10.5 g | 27.1% |
| Ethylene glycol | — | |
| AgX solvent DTOD[1] | 0.3 g | 0.77% |
| HACl[2] | 5.6 g | 14.4% |
| Water | 8.9 g | 22.9% |

[1]HO—$CH_2CH_2$—S—$CH_2CH_2$—S—$CH_2CH_2$—OH
[2]Hydroxylamine chlorhydrate

Using this concentrated solution (A), a ready-to-use developer is prepared in accordance with the operating method described above.

In this example, the developer has a lower COD than in the previous example since the quantity of concentrated solution (A), in particular the quantity of benzyl alcohol and diethylene glycol, is 30% less than that in the previous example. For 1 liter of replenisher, the contribution of concentrated solution (A) to the COD is 50 g for a total COD of approximately 60 g and the miscibility time of concentrated solution (A) in water is 110 seconds.

These results show that, when the quantity of diethylene glycol and benzyl alcohol is reduced, the COD is reduced but without modifying the miscibility time of concentrated solution (A) in water.

EXAMPLE 3 (Invention)

50 ml of a concentrated solution (A) was prepared, containing the benzyl alcohol required for the preparation of a liter of ready-to-use color developer, by mixing the following compounds:

| CONCENTRATE A | | |
|---|---|---|
| Benzyl alcohol | 13.5 g | 23.9% |
| Diethylene glycol | 27.7 g | 49.2% |
| Ethylene glycol | 6.7 g | 11.9% |
| AgX solvent DTOD(1) | 0.3 g | 0.53% |
| HACl(2) | 5.6 g | 9.95% |
| Water | 2.5 g | 4.4% |

(1)HO—$CH_2CH_2$—S—$CH_2CH_2$—S—$CH_2CH_2$—OH
(2)Hydroxylamine chlorhydrate

Using this concentrated solution (A), a ready-to-use developer is prepared in accordance with the operating method described above, except that the pH is adjusted to 11.0 in order to preserve the photographic activity.

For 1 liter of replenisher, the contribution of concentrated solution (A) to the COD is increased to 75 g for a total COD of approximately 85 g but the miscibility time of concentrated solution (A) in water is greatly reduced (20 seconds).

These results show that the miscibility time of concentrated solution (A) in water is greatly reduced when a reduction in the quantity benzyl alcohol is combined with the use of a ternary diethylene glycol/ethylene glycol/water mixture in which the quantity of water is reduced and replaced with the two co-solvents.

EXAMPLE 4 (Invention)

45 ml of a concentrated solution (A) was prepared, containing the benzyl alcohol required for the preparation of a liter of ready-to-use color developer, by mixing the following compounds:

| | | |
|---|---|---|
| Benzyl alcohol | 13.5 g | 26.5% |
| Diethylene glycol | 23.8 g | 46.7% |
| Ethylene glycol | 5.4 g | 10.6% |
| AgX solvent DTOD(1) | 0.3 g | 0.58% |
| HACl(2) | 5.6 g | 11.0% |
| Water | 2.3 g | 4.5 |

(1)HO—$CH_2CH_2$—S—$CH_2CH_2$—S—$CH_2CH_2$—OH
(2)Hydroxylamine chlorhydrate

Using this concentrated solution (A), a ready-to-use developer is prepared in accordance with the operating method of Example 3.

For 1 liter of replenisher, the contribution of concentrated solution (A) to the COD is 70 g for a total COD of approximately 80 g, but the miscibility time of concentrated solution (A) in water is 30 seconds.

These results show that, by reducing the quantities of ethylene glycol and diethylene glycol, provided that the quantity of water remains low compared with the quantities of ethylene glycol and diethylene glycol, it is possible to reduce the COD whilst preserving a reduced miscibility time compared with the concentrated solution (A) which contain similar quantities of water and diethylene glycol but not ethylene glycol.

EXAMPLE 5 (Invention)

40 ml of a concentrated solution (A) was prepared, containing the benzyl alcohol required for the preparation of a liter of ready-to-use color developer, by mixing the following compounds:

| CONCENTRATE A | | |
|---|---|---|
| Benzyl alcohol | 13.5 g | 29.9% |
| Diethylene glycol | 17.0 g | 37.7% |
| Ethylene glycol | 6.7 g | 14.8% |
| AgX solvent DTOD(1) | 0.3 g | 0.67% |
| HACl(2) | 5.6 g | 12.1% |
| Water | 2.0 g | 4.3% |

(1)HO—$CH_2CH_2$—S—$CH_2CH_2$—S—$CH_2CH_2$—OH
(2)Hydroxylamine chlorhydrate

Using this concentrated solution (A), a ready-to-use developer according to the operating method of Example 3 is prepared.

For 1 liter of replenisher, the contribution of concentrated solution (A) to the COD is 60 g and the miscibility time of concentrated solution (A) in water is reduced to 50 seconds.

These results show that it is possible to obtain a COD as low as that of reference Example 1 whilst reducing the miscibility time.

When a quantity of ethylene glycol below 13% is added, the hydroxylamine chloride no longer dissolves in concentrated solution (A). If the quantity of benzyl alcohol is below 25%, the photographic activity of the developer becomes too low.

EXAMPLE 6 (comparative)

40 ml of a concentrated solution (A) was prepared, containing the benzyl alcohol required for the preparation of a liter of ready-to-use color developer, by mixing the following compounds:

| CONCENTRATE A | | |
|---|---|---|
| Benzyl alcohol | 13.5 g | 29.0% |
| Diethylene glycol | 25.0 g | 53.9% |
| Ethylene glycol | — | |
| AgX solvent DTOD(1) | 0.3 g | 0.6% |
| HACl(2) | 5.6 g | 12.0% |
| Water | 2.0 g | 4.3% |

(1)HO—$CH_2CH_2$—S—$CH_2CH_2$—S—$CH_2CH_2$—OH
(2)Hydroxylamine chlorhydrate

With such a concentrated solution (A), it is impossible to solubilize the hydroxylamine chloride in the concentrate.

It would be possible to solubilize the hydroxylamine chloride in the concentrated solution (A) described above by replacing some of the diethylene glycol with water, but with a prolonging of the miscibility time (110 seconds).

EXAMPLE 7

7.1: a KODAK EKTACHROME RADIANCE® reversible photographic product was exposed and developed in accordance with the standard operating method of the EKTACHROME R3® process in which the developer was obtained from the concentrated solution (A) of reference Example 1.

7.2: a KODAK EKTACHROME RADIANCE® reversible photographic product was exposed and developed in accordance with the standard operating method of the EKTACHROME R3® process in which the developer was obtained from the concentrated solution (A) of Example 5 according to the invention.

The baths used in Examples 7.1 and 7.2 are seasoned baths in a processing machine (at least 3 replacements of the volume of the machine tank in accordance with the principle of replenishment processes.

The sensitometric results are set out in Table 2.

TABLE 2

| | | Ex. 7.1 | Ex. 7.2 |
|---|---|---|---|
| ER80 | R | 130 | 130 |
| | V | 131 | 130 |
| | B | 134 | 133 |
| TD08 | R | 0.13 | 0.13 |
| | V | 0.14 | 0.13 |
| | B | 0.12 | 0.12 |
| TD04 | R | 0.30 | 0.31 |
| | V | 0.34 | 0.33 |
| | B | 0.29 | 0.28 |
| SD05 | R | 1.53 | 1.52 |
| | V | 1.48 | 1.48 |
| | B | 1.52 | 1.53 |
| Dmin | R | 0.12 | 0.12 |
| | V | 0.11 | 0.11 |
| | B | 0.10 | 0.10 |
| Dmax | R | 2.43 | 2.43 |
| | V | 2.33 | 2.32 |
| | B | 2.46 | 2.46 |

For each sample the following were measured:

the sensitivity expressed by the value ER 80, which is defined by the equation ER=100(1-Log H) and measured at a density of 0.80. In this equation (H) represents the exposure required for obtaining a density of 0.80, the densities in the toe region of curve TD80 and TD04 measured respectively at 0.8 and 0.4 Log H of point (ER80), the density in the shoulder of curve SD05 measured at 0.5 Log H of point (ER80), the minimum (Dmin) and maximum (Dmax) densities. The characteristics were measured in the red, green and blue regions.

These results show that the efficacy of the developer of the present invention compared with the existing bath is preserved.

The invention has been described in detail with particular reference to preferred embodiments thereof, but it will be understood that variations and modifications can be effected within the spirit and scope of the invention.

I claim:

1. A concentrated solution free of color developing agent for the preparation of a color photographic developer, comprising: benzyl alcohol, water, ethylene glycol and diethylene glycol, characterized in that the quantity of benzyl alcohol is between 25 and 35%, the quantity of water is between 3 and 8%, the quantity of ethylene glycol is between 10 and 20% and the quantity of diethylene glycol is between 35 and 60% ; the percentages being based on the total weight of the concentrated solution, and the sum of the percentages not exceeding 100%.

2. The solution of claim 1 comprising 4–6% water, 13–17% ethylene glycol, and 43–55% diethylene glycol.

3. The solution of claim 2 comprising 30% benzyl alcohol, 38% diethylene glycol, and 15% ethylene glycol.

4. The solution of claim 1, further containing an antioxidant and a solvent for silver halides.

5. The solution of claim 4, wherein said antioxidant is hydroxylamine chlorhydrate and said solvent for silver halides is 2,2-ethylene dithioethanol.

6. A kit for providing a photographic color developer, said kit comprising a first concentrated solution as defined in claim 1, a second concentrated solution comprising a color developing agent in aqueous phase, and a third concentrated alkaline solution different from said first and second concentrated solution.

7. The kit of claim 6 wherein said color developing agent is p-phenylenediamine.

8. The kit of claim 7 wherein said color developing agent is CD-3.

9. A photographic color developer prepared by mixing a first concentrated solution of claim 1, a second concentrated solution comprising a color developing agent, and a third concentrated alkaline solution different from said first and second concentrated solutions.

10. The color developer of claim 9 having a pH of from 10.5 to 11.5.

* * * * *